US006088932A

United States Patent [19]

Adamski et al.

[11] Patent Number: 6,088,932

[45] Date of Patent: Jul. 18, 2000

[54] EFFICIENCY CLOTHES DRYER

[75] Inventors: Joseph R. Adamski; Edward R. Cook, both of Cedar Rapids, Iowa; Shou-Heng Huang, Santa Cruz, Calif.; Arlynn Sanders, Ripon, Wis.

[73] Assignee: Amana Company, L.P., Amana, Iowa

[21] Appl. No.: 09/000,573

[22] Filed: Dec. 30, 1997

[51] Int. Cl.[7] ..... F26B 3/34

[52] U.S. Cl. ..... 34/274; 34/278; 34/606; 34/607

[58] Field of Search ..... 34/60, 266, 267, 34/274, 275, 278, 426, 595, 604, 606, 607; 68/12.01, 12.02, 12.03

[56] References Cited

U.S. PATENT DOCUMENTS

| | | | |
|---|---|---|---|
| 2,406,494 | 8/1946 | Ferris . | |
| 2,805,556 | 9/1957 | Wang | 62/457.4 |
| 3,089,317 | 5/1963 | Bufalini | 62/457.4 |
| 3,715,895 | 2/1973 | Devlin | 62/457 |
| 4,182,050 | 1/1980 | Righi | 34/60 |
| 4,232,532 | 11/1980 | Marsh | 62/457.4 |
| 5,361,604 | 11/1994 | Pier et al. | 62/457.4 |
| 5,546,678 | 8/1996 | Dhaemers | 34/275 |
| 5,653,124 | 8/1997 | Weber | 62/457.4 |
| 5,664,340 | 9/1997 | Brown | 34/275 |
| 5,724,750 | 3/1998 | Burress | 34/267 |

FOREIGN PATENT DOCUMENTS

| | | |
|---|---|---|
| 3 324 350 A1 | 1/1985 | Germany . |
| 39 03 185 | 8/1990 | Germany . |
| 2 150 681 A1 | 7/1985 | United Kingdom . |

*Primary Examiner*—Stephen Gravini
*Attorney, Agent, or Firm*—Tobor, Goldstein & Healey, L.L.P.

[57] ABSTRACT

A clothes dryer has a plurality of high energy lamps. The high energy lamps are mounted so as to emit high energy radiation toward a drying chamber. A blower is arranged to move air to the plurality of high energy lamps so as cool the high energy lamps. The air that cools the high energy lamps is delivered to the drying chamber. The plurality of high energy lamps is operated to emit ultraviolet energy for sanitizing the articles in the drying chamber and to emit infrared energy for drying the articles in the drying chamber.

38 Claims, 4 Drawing Sheets

FIG. 1
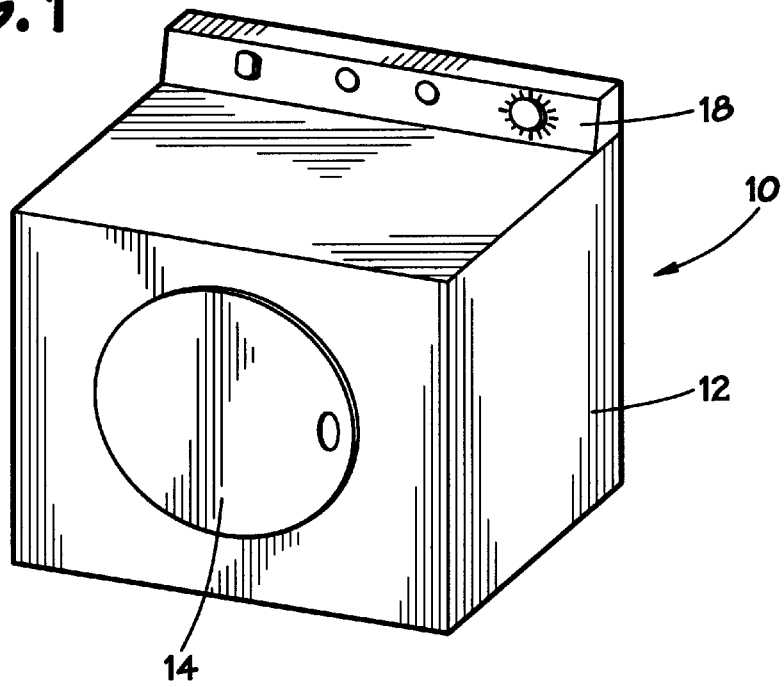
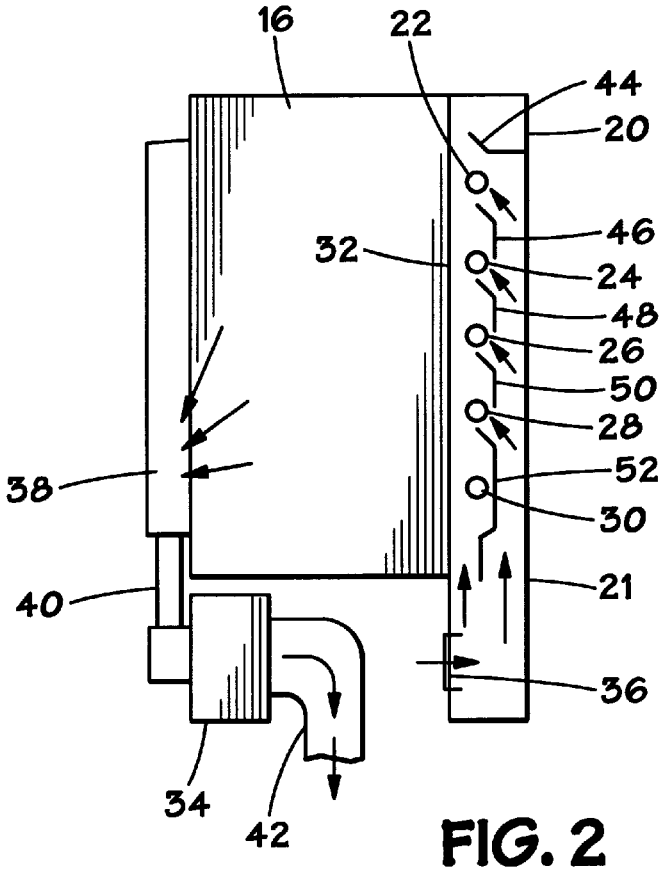
FIG. 2

EFFICIENCY CLOTHES DRYER

TECHNICAL FIELD OF THE INVENTION

The present invention is directed to a clothes dryer and, more particularly, to a clothes dryer employing radiant energy drying.

BACKGROUND OF THE INVENTION

A conventional clothes dryer comprises a drum, a heating coil, a blower, a filter, a drum motor to turn the drum, a blower motor to drive the blower, an air channel to direct air flow created by the blower, and a control system. In order to initiate a drying cycle, the user of the clothes dryer inserts wet fabrics inside of the drum and selects an appropriate heat level and drying time. The control system responds to these selections by energizing the drum motor and the blower motor. The drum motor turns the drum in order to tumble the wet fabrics as they are dried. The blower motor drives the blower so that air is drawn into the clothes dryer from ambient. The air channel directs the air as the air moves through the clothes dryer. Accordingly, the air is first passed over the heating coil where the air is heated. The heated air is directed into the drum where it evaporates water from the wet fabrics. Moisture laden air passes from the drum through the filter and then is exhausted from the clothes dryer to ambient.

The air supplied to the drum is heated by the heating coils because warm air picks up more moisture than cool air. The moist air is passed through the filter in order to filter out lint and other particles before the air is exhausted from the dryer. Typically, the exhausted air is vented outside of the building in which the clothes dryer is located.

This operation continues for the selected amount of drying time, after which the clothes dryer shuts off. However, some clothes dryers have humidity sensors to sense the humidity of the air exhausted from the clothes dryer. When the humidity sensor senses that the humidity of the exhaust air is below a pre-determined level (indicating, by inference, that the fabrics are dry), the control system of such a clothes dryer terminates its drying operation. Still other clothes dryers have conductive fingers to sense the amount of moisture in the fabrics being dried by the clothes dryer. When the conductivity across the conductive fingers decreases below a pre-determined level (indicating, by inference, that the fabrics are dry), the control system of such a clothes dryer terminates its drying operation.

The heating coil typically used in conventional clothes dryers is an electric resistant heater. Following energization, an electric resistance heater heats up slowly causing a delay in delivering heated air to the drum of a clothes dryer. The longer the delay, the longer the time required to dry fabrics. Furthermore, such heating coils dry primarily through convection heating. Convection heating has limited sanitation capabilities. In order to adequately sanitize the fabrics being dried, the electric resistance heater would have to be operated at a temperature which might damage those fabrics. Accordingly, to prevent such damage, an electric resistance heater of a clothes dryer is operated at a temperature which is sufficient to dry fabrics but which is insufficient to adequately sanitize them.

The present invention is intended to solve one or more of the above-noted problems.

SUMMARY OF THE INVENTION

According to a first aspect of the present invention, a heating unit for a clothes dryer comprises a radiant energy emitting means and a housing means. The radiant energy emitting means emits radiant energy. The housing means houses the radiant energy emitting means so that the radiant energy emitted by the radiant energy emitting means is directed to clothing articles to be dried.

According to another aspect of the present invention, a heating arrangement for a clothes dryer comprises a radiant energy emitting means, a cooling means, and a directing means. The radiant energy emitting means emits radiant energy to articles to be dried. The cooling means cools the radiant energy emitting means, thereby collecting heat from the radiant energy emitting means. The directing means directs the heat collected by the cooling means to the articles to be dried.

According to yet another aspect of the present invention, a clothes dryer comprises a drying chamber, an air blower, a plurality of high energy radiators, and first and second air channels. The high energy radiators are arranged to emit high energy radiation toward the drying chamber. The first air channel is arranged to direct air moved by the air blower to the plurality of high energy radiators so as to cool the high energy radiators and to direct the air that cools the high energy radiators to the drying chamber. The second air channel is arranged to exhaust air from the drying chamber.

BRIEF DESCRIPTION OF THE DRAWINGS

These and other features and advantages of the present invention will become more apparent from a detailed consideration of the invention when taken in conjunction with the drawings in which:

FIG. 1 is an isometric view of a clothes dryer utilizing the present invention;

FIG. 2 is a schematic side view showing a heating unit, a drum, and a blower of the clothes dryer shown in FIG. 1;

DETAILED DESCRIPTION

Figure 3:
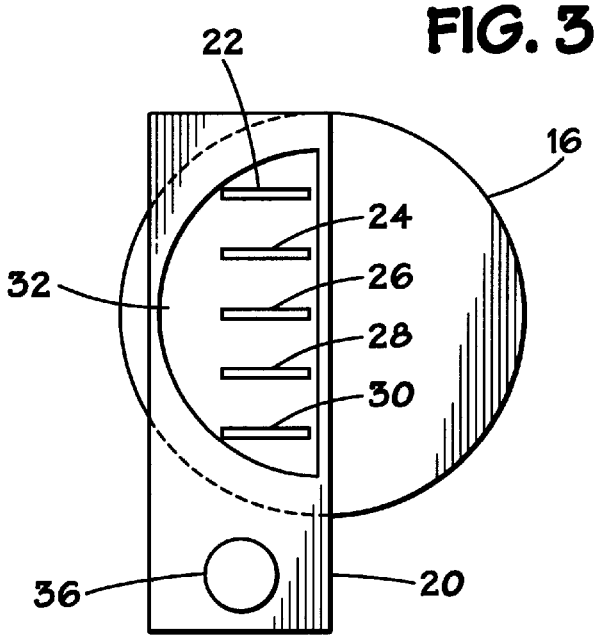
FIG. 3 is a schematic front view showing the heating unit in relation to the drum shown in FIG. 2; and, FIGS. 4–8 show an alternative embodiment of the present invention.

As shown in FIG. 1, a clothes dryer 10 includes a cabinet 12 and a door 14. The door 14 may be opened to provide access through the cabinet 12 to a drum 16 shown schematically in FIG. 2. A control panel 18 is mounted to the top of the cabinet 12 and permits the user to select drying times and temperatures for different types of fabrics. The drum 16 is rotated by a drum motor (not shown) in order to tumble the fabrics which are inserted into the drum 16 for drying.

As shown in FIG. 2, a heating unit 20 having a housing 21, replaces the conventional electric resistance heater used in typical clothes dryers. The heating unit 20 acts as a first air channel. The housing 21 of the heating unit 20 houses a plurality of tungsten-halogen lamps 22, 24, 26, 28, and 30. Such lamps have a tungsten filament surrounded by a quartz envelope which is filled with a halogen gas. Each of the tungsten-halogen lamps 22–30 may be a one kilowatt tungsten-halogen lamp, for example.

As shown in FIG. 3, the heating unit 20 has an opening 32 which is between the tungsten-halogen lamps 22–30 and the drum 16. Accordingly, the tungsten-halogen lamps 22–30, when energized, emit radiant energy through the opening 32 and into the drum 16. The opening 32 may be covered by a mesh screen or a transparent glass shield in order to prevent the fabrics being dried from touching the tungsten-halogen lamps 22–30, which are typically operated at high temperatures.

A blower 34 is arranged to draw air into an inlet opening 36 in the heating unit 20, and the heating unit 20 directs this air over the tungsten-halogen lamps 22–30. This air exits the heating unit 20 into the drum 16 through the opening 32. The air picks up moisture from the fabrics being in dried the drum 16 and then exits the drum 16 through a second air channel 38 which may contain a filter. The air then flows through an air conduit 40, through the blower 34, and out to ambient through an exhaust pipe 42. Typically, the exhaust pipe 42 discharges this air outside of the building in which the clothes dryer 10 is located and, in any case, into an area which is not accessible to the inlet opening 36.

The heating unit 20 includes a plurality of baffles 44, 46, 48, 50, and 52. As shown by the arrows in FIG. 2, these baffles 44–52 are arranged to direct air over the tungsten-halogen lamps 22–30. Accordingly, the air that is drawn through the heating unit 20 cools the tungsten-halogen lamps 22–30. Moreover, the heat that is picked up by the air which cools these tungsten-halogen lamps 22–30 is discharged into the drum 16 and further enhances the drying of the fabrics within the drum 16. The baffles 44–52 may also serve as reflectors. Thus, the tungsten-halogen lamps 22–30 emit radiant energy directly into the drum 16 and emit radiant energy indirectly into the drum 16 because of reflection by the baffles 44–52.

The tungsten filaments of the tungsten-halogen lamps 22–30 may be operated to have a radiation energy peak at a wavelength in the range of one to three microns. For example, the tungsten elements of the tungsten-halogen lamps 22–30 may be operated at about 2,200K, which produces a radiation energy peak at a wavelength of about 1.3 micron, or the tungsten elements of the tungsten-halogen lamps 22–30 may be operated at about 3,000K, which produces a radiation energy peak at a wavelength of about 0.966 micron. Radiation at this wavelength efficiently removes water from textiles.

In order to sanitize the fabrics being dried in the drum 16, one or more germicidal lamps may be added to, or replace one or more of, the tungsten-halogen lamps 22–30 and may be operated so as to emit ultraviolet radiation while the tungsten-halogen lamps 22–30 may be operated so as to emit infrared radiation. For example, the one or more germicidal lamps may be operated to have an energy peak at a wavelength of about 0.254 micron (which is within the ultraviolet range) while the tungsten-halogen lamps 22–30 may be operated to have an energy peak at a wavelength in the range of 1 micron to 3 microns. Alternatively, the tungsten-halogen lamps 22–30 may be cycled in unison to emit drying infrared radiation during parts of a drying cycle and sanitizing ultraviolet radiation during other parts of the drying cycle. Accordingly, fabrics in the drum 16 are both dried and sanitized.

An alternative embodiment of the present invention is illustrated in FIGS. 4–8. As shown therein, a drum 60 is provided for tumbling fabrics to be dried. A glass panel 62 at the rear of the drum 60 forms a barrier between the interior of the drum 60 and a tungsten-halogen lamp array 64. Radiant energy is emitted by the tungsten-halogen lamp array 64 through the glass panel 62 and enters the drum 60 so as to dry the fabrics therein. For this purpose, the drum 60 may have a perforated end facing the glass panel 62. The drum 60 may be alternatively formed so as to allow radiant energy from the tungsten-halogen lamp array 64 to enter the drum 60. Accordingly, radiant energy from the tungsten-halogen lamp array 64 enters the interior of the drum 60 in order to dry fabrics contained therein.

Figure 4:
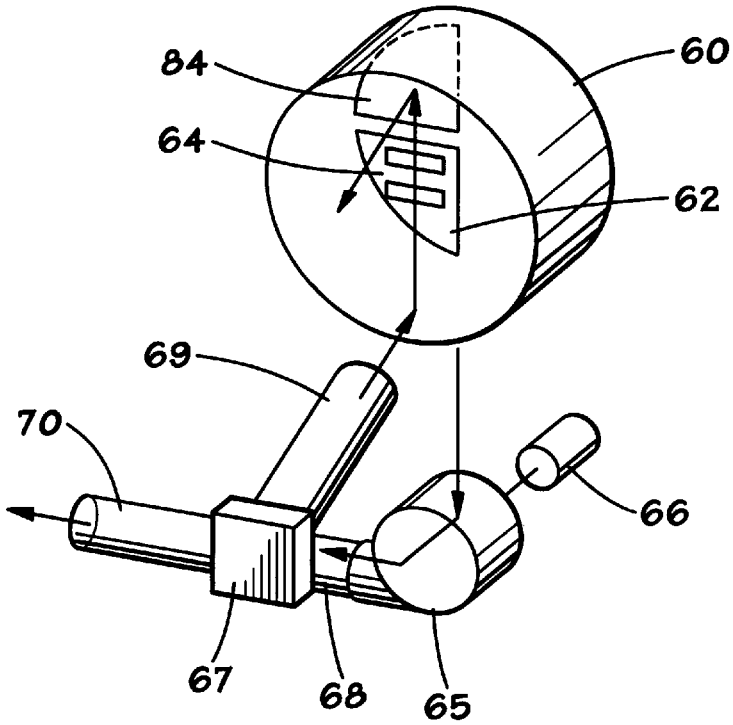
Figure 7:
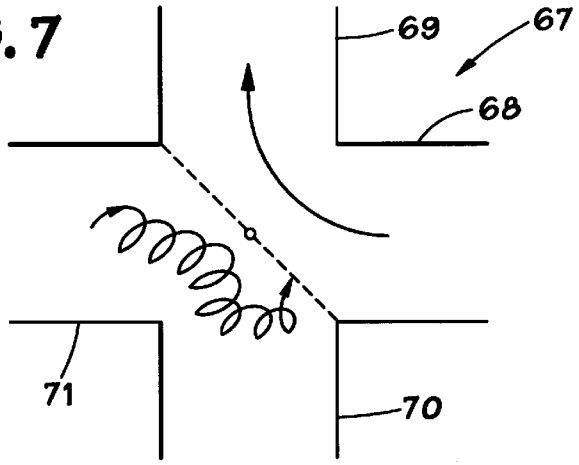
Figure 8:
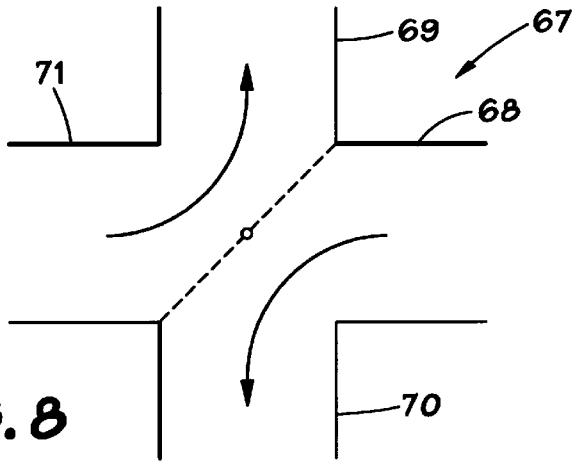

As shown in FIGS. 4, 7, and 8, air is circulated through the drum 60 by a blower 65 operated by a blower motor 66 under control of a recirculation valve 67. When the recirculation valve 67 is in its recirculation position, the blower 65 circulates air from the drum 60 through a conduit 68, through the recirculation valve 67, and through a conduit 69 back to the drum 60. Accordingly, this air picks up moisture from the articles being dried.

As shown in FIGS. 4 and 8, when the recirculation valve 67 is in its discharge position, the blower 65 exhausts air from the drum 60 through the conduit 68, through the recirculation valve 67, and then through a conduit 70 to an exhaust pipe (not shown) which may be arranged to discharge the moisture laden air from the building in which the clothes drier is located. This recirculation causes a vacuum in the drum 60 which causes fresh air to be drawn into the drum 60 through a fresh air conduit 71, through the recirculation valve 67, and through the conduit 69 back to the drum 60.

Figure 5:
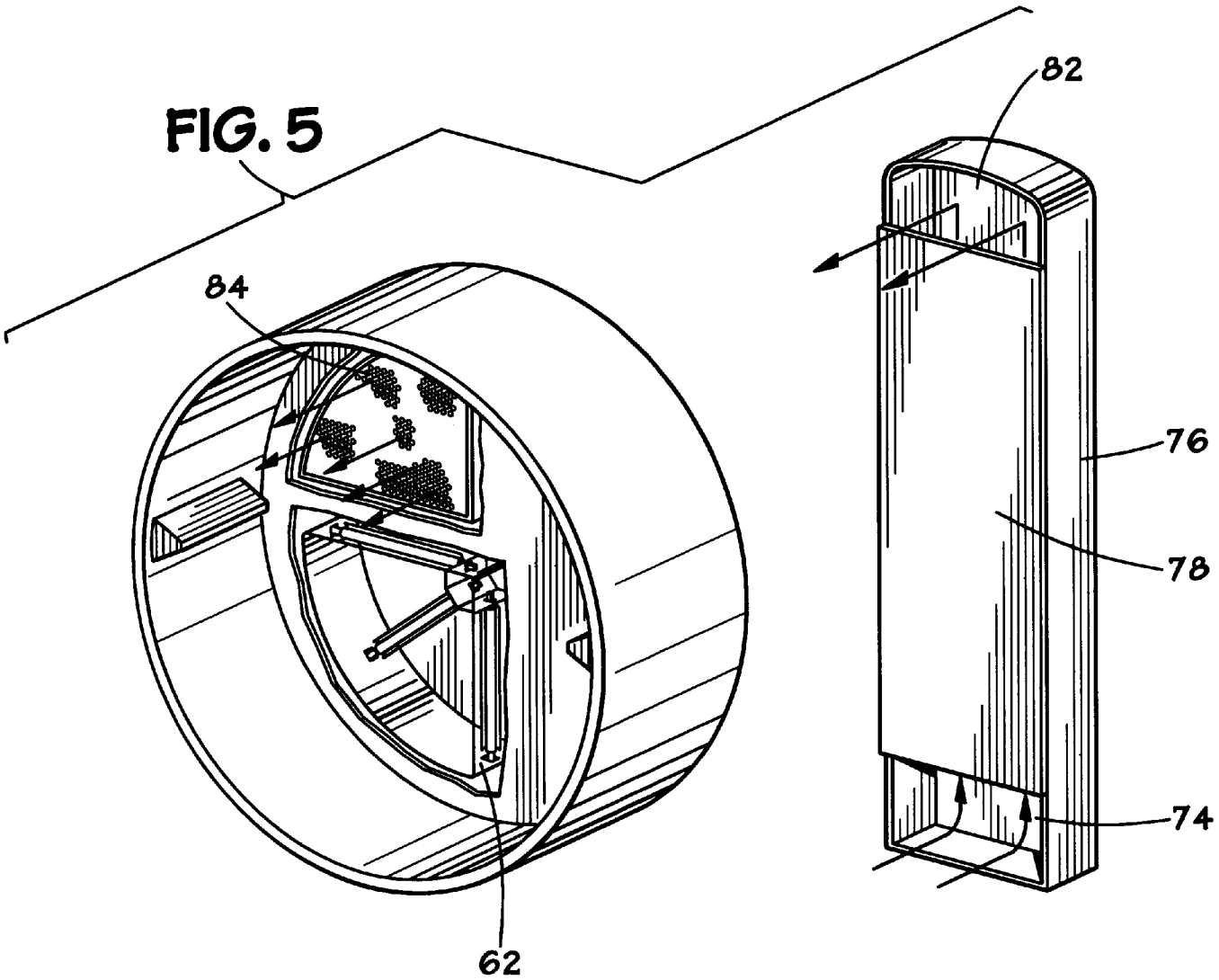
Figure 6:
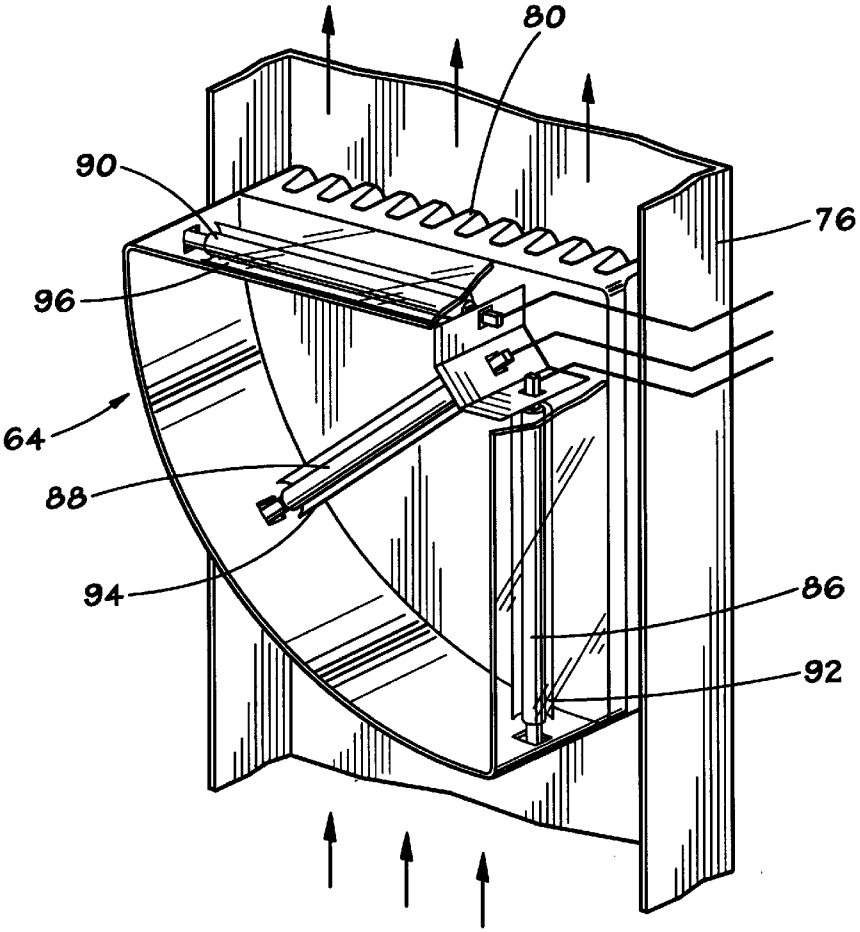

As shown in FIGS. 5 and 6, the air flowing through the conduit 69 is directed to an inlet opening 74 of an air channel 76. The air channel 76 has a front face 78, a portion of which may be formed as a heat exchanger 80. The heat exchanger 80 is in heat exchange relationship with the tungsten-halogen lamp array 64. Accordingly, heat is removed from the tungsten-halogen lamp array 64 by the heat exchanger 80 which is cooled by the air moving through the air channel 76. The heated air exits the air channel 76 through an outlet opening 82 and enters the drum 60 through a inlet opening 84 at the rear of the drum 60. Because the drum 60 is perforated or is otherwise formed as discussed above, the air from the inlet opening 84 enters the drum 60.

The tungsten-halogen lamp array 64, for example, may comprise three tungsten-halogen lamps 86, 88, and 90 of the type described above. The tungsten-halogen lamps 86–90 may be operated in a manner similar to the way in which the tungsten-halogen lamps 22–30 are operated, as described above.

The air that is blown through the air channel 76 picks up the heat that is generated by the tungsten-halogen lamps 86–90 and that is removed from the tungsten-halogen lamps 86–90 by the heat exchanger 80. This heated air is discharged through the outlet opening 82 of the air channel 76 and through the inlet opening 84 into the drum 60. The heat in this air increases the drying capability of the radiant energy emitted by the tungsten-halogen lamps 86–90.

The tungsten-halogen lamps 86–90 may have corresponding reflectors 92, 94, and 96 arranged to reflect radiant energy from the tungsten-halogen lamps 86–90 toward the drum 60. Thus, the tungsten-halogen lamps 86–90 emit radiant energy directly into the drum 60 and emit radiant energy indirectly into the drum 60 because of reflection by the reflectors 92–96.

Certain modifications of the present invention have been discussed above. Other modifications will occur to those practicing in the art of the present invention. For example, an outlet damper may be used at the outlet of the drum so that air in the drum is not exhausted from the drum until the air reaches a pre-determined humidity level. In this manner, drying efficiency is increased by using the majority of the air's moisture absorbing capacity.

Also, the heating elements described above are tungsten-halogen lamps. However, other heating elements, such as nichrome elements, which emit high power density radiant energy, may be used in connection with the present invention.

Moreover, separate motors may be employed to drive the drum and the blower, or the drum and the blower may be driven by the same motor.

Furthermore, the reflectors described above may be parabolic or pseudo-parabolic reflectors.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A heating unit for a clothes dryer comprising:

radiant energy emitting means for emitting radiant energy;

a blower for providing an air flow that flows past the radiant energy emitting means; and housing means for housing the radiant energy emitting means so that the radiant energy emitted by the radiant energy emitting means is directed to clothing articles to be dried, the housing means having a plurality of baffles, the baffles deflecting the air flow toward the clothing articles, and the plurality of baffles reflecting the radiant energy toward the clothing articles.

2. The heating unit of claim 1 wherein the radiant energy emitting means comprises a plurality of high energy lamps.

3. The heating unit of claim 2 wherein one of the high energy lamps is operated to emit ultraviolet energy, and wherein another of the high energy lamps is operated to emit infrared energy.

4. The heating unit of claim 2 wherein one of the high energy lamps is operated so as to have an energy peak at a wavelength of about 0.254 micron, and wherein another of the high energy lamps is operated so as to have an energy peak at a wavelength in a range of about one micron to about three micron.

5. The heating unit of claim 2 wherein the high energy lamps are operated to emit ultraviolet energy and infrared energy.

6. The heating unit of claim 2 wherein the high energy lamps are operated so as to have a first energy peak at a wavelength about 0.254 micron and to have a second energy peak at a wavelength in a range of about one micron to about three micron.

7. The heating unit of claim 2 wherein the high energy lamps are tungsten-halogen lamps.

8. The heating unit of claim 1 wherein the radiant energy emitting means is operated to emit ultraviolet energy and infrared energy.

9. The heating unit of claim 1 wherein the radiant energy emitting means is operated so as to have a first energy peak at a wavelength of about 0.254 micron and to have a second energy peak at a wavelength in a range of about one micron to about three micron.

10. A heating arrangement for a clothes dryer comprising:

radiant energy emitting means for emitting radiant energy to articles to be dried;

cooling means for cooling the radiant energy emitting means, the cooling means collecting heat from the radiant energy emitting means, the cool means having a conduit that is in a heat transfer relationship with the radiant energy emitting means, the cooling means further having an airflow that flows past the radiant energy emitting means through the conduit; and directing means for directing the heat collected by the cooling means to the articles to be dried.

11. The heating arrangement of claim 10 wherein the radiant energy emitting means comprises a plurality of high energy lamps.

12. The heating arrangement of claim 11 wherein one of the high energy lamps is operated to emit ultraviolet energy, and wherein another of the high energy lamps is operated to emit infrared energy.

13. The heating arrangement of claim 11 wherein one of the high energy lamps is operated so as to have an energy peak at a wavelength of about 0.254 micron, and wherein another of the high energy lamps is operated so as to have an energy peak at a wavelength in a range of about one micron to about three micron.

14. The heating arrangement of claim 11 wherein the high energy lamps are operated to emit ultraviolet energy and infrared energy.

15. The heating arrangement of claim 11 wherein the high energy lamps are operated so as to have a first energy peak at a wavelength of about 0.254 micron and to have a second energy peak at a wavelength in a range of about one micron to about three micron.

16. The heating arrangement of claim 11 wherein the high energy lamps are tungsten- halogen lamps.

17. The heating arrangement of claim 10 wherein the radiant energy emitting means is operated to emit ultraviolet energy and infrared energy.

18. The heating arrangement of claim 10 wherein the radiant energy emitting means is operated so as to have a first energy peak at a wavelength of about 0.254 micron and to have a second energy peak at a wavelength in a range of about one micron to about three micron.

19. The heating arrangement of claim 10 wherein the cooling means comprises a heat exchanger in heat transfer relationship with the radiant energy emitting means, wherein the cooling means comprises means for passing air over the heat exchanger, and wherein the directing means directs the air passed over the heat exchanger to the articles to be dried.

20. The heating arrangement of claim 19 wherein the radiant energy emitting means is operated to emit ultraviolet energy and infrared energy.

21. The heating arrangement of claim 19 wherein the radiant energy emitting means is operated so as to have a first energy peak at a wavelength of about 0.254 micron and to have a second energy peak at a wavelength in a range of about one micron to about three micron.

22. The heating arrangement of claim 10 wherein the cooling means comprises means for passing cooling air over the radiant energy emitting means, and wherein the directing means directs the air passed over the radiant energy emitting means to the articles to be dried.

23. The heating arrangement of claim 22 wherein the radiant energy emitting means is operated to emit ultraviolet energy and infrared energy.

24. The heating arrangement of claim 22 wherein the radiant energy emitting means is operated so as to have a first energy peak at a wavelength of about 0.254 micron and to have a second energy peak at a wavelength in a range of about one micron to about three micron.

25. The heating arrangement of claim 10 wherein the radiant energy emitting means is arranged to emit radiant energy directly toward articles to be dried, and wherein the radiant energy emitting means includes reflectors arranged to reflect emitted radiant energy indirectly toward articles to be dried.

26. A clothes dryer comprising:

A drying chamber;

an air blower;

a plurality of high energy radiators, the high energy radiators being arranged to emit high energy radiation directly into the drying chamber;

a first air channel having a plurality of baffles arranged to direct air moved by the air blower to the plurality of high energy radiators so as to cool the high energy radiators, the baffles being arranged to direct the air that cools the high energy radiators to the drying chamber, the baffles reflecting the high energy radiation indirectly into the drying chamber; and a second air channel arranged to exhaust air from the drying chamber.

27. The clothes dryer of claim 26 wherein one of the high energy radiators is operated to emit ultraviolet energy, and wherein another of the high energy radiators is operated to emit infrared energy.

28. The clothes dryer of claim 26 wherein one of the high energy radiators is operated so as to have an energy peak at a wavelength of about 0.254 micron, and wherein another of the high energy radiators is operated so as to have an energy peak at a wavelength in a range of about one micron to about three micron.

29. The clothes dryer of claim 26 wherein the high energy radiators are operated to emit ultraviolet energy and infrared energy.

30. The clothes dryer of claim 26 wherein the high energy radiators art operated so as to have a first energy peak at a wavelength of about 0.254 micron and to have a second energy peak at a wavelength in a range of about one micron to about three micron.

31. The clothes dryer of claim 26 wherein the first air channel comprises a heat exchanger in heat transfer relationship with the high energy radiators, and wherein the first air channel is arranged to pass air over the heat exchanger and to deliver the air passed over the heat exchanger to the drying chamber.

32. The clothes dryer of claim 31 wherein the high energy radiators are operated to emit ultraviolet energy and infrared energy.

33. The clothes dryer of claim 31 wherein the high energy radiators are operated so as to have a first energy peak at a wavelength of about 0.254 micron and to have a second energy peak at a wavelength in a range of about one micron to about three micron.

34. The clothes dryer of claim 26 wherein the high energy radiators are in the first air channel, and wherein the first air channel is arranged to pass air over the high energy radiators and to deliver the air passed over the high energy radiators to the drying chamber.

35. The clothes dryer of claim 34 wherein the high energy radiators are operated to emit ultraviolet energy and infrared energy.

36. The clothes dryer of claim 34 wherein the high energy radiators are operated so as to have a first energy peak at a wavelength of about 0.254 micron and to have a second energy peak at a wavelength in a range of about one micron to about three micron.

37. The clothes dryer of claim 34 wherein the first air channel includes an opening arranged to admit air into the first air channel, and wherein the second air channel includes a first conduit between the drying chamber and the air blower and a second conduit between the air blower and exhaust.

38. The clothes dryer of claim 26 wherein the high energy radiators are tungsten-halogen lamps.

* * * * *

UNITED STATES PATENT AND TRADEMARK OFFICE

CERTIFICATE OF CORRECTION

PATENT NO. : 6,088,932

DATED : July 18, 2000

INVENTOR(S) : Joseph R. Adamski, et al

It is certified that error appears in the above-identified patent and that said Letters Patent is hereby corrected as shown below:

In Claim 10, Column 5, line 58, delete "cool", and insert "--cooling--".

Signed and Sealed this

Seventeenth Day of April, 2001

*Attest:*

Nicholas P. Godici

NICHOLAS P. GODICI

*Attesting Officer*

*Acting Director of the United States Patent and Trademark Office*